US007333931B2

(12) United States Patent
Bozkurt et al.

(10) Patent No.: US 7,333,931 B2
(45) Date of Patent: Feb. 19, 2008

(54) METHOD FOR ESTIMATING RESONANCE FREQUENCIES

(75) Inventors: Baris Bozkurt, Mons (BE); Thierry Dutoit, Sirault (BE); Christophe D'Alessandro, Paris (FR); Boris Doval, Paris (FR)

(73) Assignee: Faculte Polytechnique De Mons (BE)

( * ) Notice: Subject to any disclaimer, the term of this patent is extended or adjusted under 35 U.S.C. 154(b) by 0 days.

(21) Appl. No.: 10/568,150

(22) PCT Filed: Aug. 11, 2004

(86) PCT No.: PCT/BE2004/000116

§ 371 (c)(1),
(2), (4) Date: Feb. 10, 2006

(87) PCT Pub. No.: WO2005/031702

PCT Pub. Date: Apr. 7, 2005

(65) Prior Publication Data

US 2006/0229868 A1 Oct. 12, 2006

Related U.S. Application Data

(60) Provisional application No. 60/564,054, filed on Apr. 21, 2004, provisional application No. 60/494,375, filed on Aug. 11, 2003.

(51) Int. Cl.
*G10L 11/00* (2006.01)

(52) U.S. Cl. ..... 704/206

(58) Field of Classification Search ..... 704/206
See application file for complete search history.

(56) References Cited

U.S. PATENT DOCUMENTS 6,069,857 A * 5/2000 Schell et al. ..... 369/53.28
6,704,711 B2 * 3/2004 Gustafsson et al. ..... 704/258

OTHER PUBLICATIONS

Bozkurt et al., "Mixed-Phase Speech Modeling and Formant Estimation, Using Differential Phase Spectrums," PROC. ISCA ITRW VOQUAL 2003, 'Online! Aug. 27, 2003, pp. 21-24, XP002312214.
Doval et al., "The Voice Source as a causal/anticausal linear filter," PROC. ISCA ITRW VOQUAL 2003, 'Online! Aug. 27, 2003, sheets 15-20, XP002312215.
Jackson, "Noncausal ARMA Modeling of Voiced Speech," IEEE Transactions on Acoustics, Speech and Signal Processing, Oct. 1989, abstract, XP002312218.

(Continued)

*Primary Examiner*—Susan McFadden
(74) *Attorney, Agent, or Firm*—Knobbe Martens Olson & Bear LLP

(57) ABSTRACT

The present invention is related to a method for estimating from an input signal the resonance frequencies of a system modelled as a source and a filter, comprising the steps of—determining the Z-transform of the input signal,—calculating the differential-phase spectrum of the Z-transformed input signal, whereby the Z-transform is evaluated on a circle centered around the origin of the Z-plane,—detecting the peaks on said differential-phase spectrum,—attributing the peaks to either the source or the filter,—estimating the resonance frequencies from the peaks.

11 Claims, 4 Drawing Sheets

OTHER PUBLICATIONS

Reddy et al., "High-Resolution Formant Extraction from Linear-Prediction Phase Spectra," IEEE Transactions on Acoustics, Speech and Signal Processing, Dec. 1984, abstract, XP002312216.

Reddy et al., "High-Resolution Formant Extraction from Linear-Prediction Phase Spectra," IEEE Transactions on Acoustics, Speech, and Signal Processing, vol. ASSP-32, No. 6, Dec. 6, 1984, pp. 1136-1144.

Duncan et al., "A Nonparametric Method of Formant Estimation Using Group Delay Spectra," 1989 International Conference on Acoustics, Speech and Signal Processing, abstract, XP002312217.

Doval et al., "Spectral Correlates of Glottal Waveform Models: An Analytic Study," 1997 IEEE International Conference on Acoustics, Speech, and Signal Processing, abstract, XP002312219.

* cited by examiner

METHOD FOR ESTIMATING RESONANCE FREQUENCIES

This is the U.S. National Phase of International Patent Application No. PCT/BE2004/000116 filed on Aug. 11, 2004 under the Patent Cooperation Treaty (PCT), which was published by the International Bureau in English on Apr. 7, 2005 as WO 2005/031702 A1, which designates the U.S. and is a non-provisional application of U.S. Provisional Patent Application Nos. 60/494,375, filed Aug. 11, 2003 and 60/564,054, filed Apr. 21, 2004, each of which is incorporated by reference.

FIELD OF THE INVENTION

The present invention is related to an analysis technique for recorded speech signals that can be used in various fields of speech processing technology.

STATE OF THE ART

In all fields of speech processing, the basic source-filter speech model is very frequently used. It mainly assumes that the speech signal is produced by exciting a filter (corresponding to vocal tract), e.g., by an excitation produced by the lung pressure and larynx (source signal or the glottal flow signal).

Decomposition of the two systems (the source and the filter (or the vocal tract)) has been an interesting problem in all areas of speech processing. The source and the filter characteristics provide very useful information for speech applications. In many applications, removing one system's effect on the other improves the quality of analysis performed by the application. For example, in speech synthesis, source signal characteristics estimation is very important for voice quality analysis of speech, database labelling (for voice quality and prosodic events), speech quality modification (emotional speech synthesis). Both systems (the source and the tract) show some resonance characteristics, which are considered to be their essential features. These resonances are called the formants and their estimation has been studied by various researchers, especially for the filter part. However, estimation of the spectral resonance of the source (called the glottal formant) as presented in the present application is rather a new concept.

In a more theoretical framework, resonances of speech signals are modelled with poles in the z-domain. Linear predictive (LP) analysis is the most frequently used technique for estimating signal resonances by pole estimation. Based on an all-pole model, LP analysis estimates poles of a system, which correspond to resonances of a signal. Once the resonances are estimated with LP analysis, the problem is reduced to relating source and tract resonances respectively, a difficult and important problem in speech processing technology. There are many difficulties and inefficiencies of LP estimation due to various problems like non-linear source-tract interaction, dependency on degree of linear prediction and separating source resonances from vocal tract.

Despite the disadvantages of LP analysis, various methods have been proposed for source-tract separation using LP analysis. One of the well-known algorithms is the Pitch Synchronous Iterative Adaptive Inverse Filtering (PSIAIF) (see '*Glottal Wave Analysis with PSIAIF', Alku, Speech Communication*, vol. 11, pp. 109-117, 1992), which tries to perform the separation by an iterative linear prediction analysis. There also exist methods based on the linear prediction analysis together with glottal flow models. All of these techniques suffer from the deficiencies of the LP approach because LP estimation is hard-coded in these techniques.

Current state of art based on LP autocorrelation analysis is capable of detecting speech signal resonances but incapable of detecting anti-causal and causal resonances respectively, which proves to be a major drawback.

In two approaches closest to the methodology adopted herein are those of Rabiner (*'System for automatic formant analysis of voiced speech'*, Rabiner and Schafer, *JASA*, vol. 47, no. 2/2, pp. 634-648, 1970) and Murthy and Yegnanarayana (*'Formant extraction from group delay function', Speech Communication*, vol. 10, no. 3, pp. 209-221, August, 199). Both methodologies are based on spectral processing of speech. Rabiner's approach is based on analysis of the Z-transform amplitude spectrum and Murthy's on the minimum phase group delay function derived from amplitude spectrum. In both cases one of the most important method steps is the cepstral smoothing.

SUMMARY OF CERTAIN INVENTIVE ASPECTS

Aspects of the invention include a method for estimating the formant frequencies for vocal tract and glottal flow, directly from speech signals and further include a computer usable medium that implements such a method.

In one aspect of the invention there is a method for estimating from an input signal the resonance frequencies of a system modeled as a source and a filter, comprising determining the Z-transform of the input signal, calculating the differential-phase spectrum of the Z-transformed input signal (without using the amplitude spectrum), whereby the Z-transform is evaluated on a circle centered around the origin of the Z-plane, detecting the peaks on the differential-phase spectrum, distributing the peaks to either the source or the filter, and estimating the resonance frequencies from the peaks.

In a preferred embodiment the circle on which the Z-transform is evaluated, is different from the unit circle in the Z-plane. Advantageously, the Z-transform of the input signal is evaluated on more than one circle.

In another embodiment the input signal is windowed.

Typically the input signal is a speech signal.

Preferably the source is a glottal flow signal and the filter is a vocal tract system.

In an advantageous embodiment attributing the peaks is performed based on the sign of said peaks. Said attributing is preferably further based on the radius of said circle.

In an alternative embodiment the method for estimating the resonance frequencies further comprises removing zeros of the input signal's Z-transform before performing calculating the differential-phase spectrum.

In another embodiment there is a computer usable medium having computer readable program code embodied therein for estimating from an input signal the resonance frequencies of a system modeled as a source and a filter, the computer readable code comprising instructions for determining the Z-transform of said input signal, calculating the differential-phase spectrum of said Z-transformed input signal, said Z-transform thereby being evaluated on a circle centered around the origin of the Z-plane, detecting the peaks on said differential-phase spectrum, attributing said peaks to either said source or said filter, and estimating said resonance frequencies from said peaks.

SHORT DESCRIPTION OF THE DRAWINGS

DETAILED DESCRIPTION OF CERTAIN INVENTION EMBODIMENTS

Certain embodiments target the estimation of resonance frequencies (formant frequencies) of the source and the vocal tract contributions directly from the speech signal itself.

As will be shown, the source-tract separation problem needs to be handled with tools, which can detect anti-causal resonances. The technique is more effective than current state of the art methods, mainly because it is capable of detecting causal and anti-causal resonances without utilization of a particular model of analysis, but only with spectral peak analysis. Additionally, the technique has no dependency on analysis degrees as in LP analysis systems.

Figure 1:
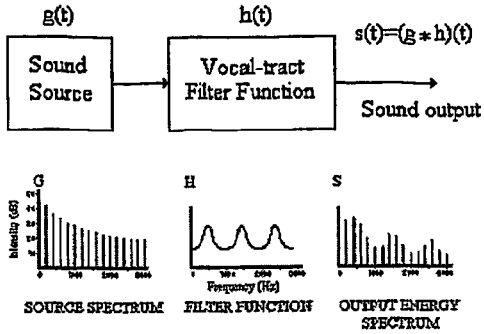
FIG. 1 represents the source-filter speech model.

The source-filter model (see FIG. 1) is usually accompanied by the assumption that a speech signal is a physical system output and therefore it is the output of a stable filter system. In a stable causal linear time invariant system, all the resonances of the signal shall correspond to poles inside the unit circle in z-plane. Once it is also assumed that the system is all-pole (i.e., the system can be defined by only poles and a gain factor), one ends up with a minimum phase system (the systems having all zeros and poles inside the unit circle are classified as minimum phase systems). Speech signals have been assumed to be minimum-phase signals for long years in many studies.

Here a mixed-phase speech model is applied, where some signal resonances correspond to poles outside the unit-circle but these poles are anti-causal, therefore still stable. These anti-causal poles correspond to resonances of the glottal source signal and causal-stable poles (inside the unit circle) correspond to the vocal tract resonances.

A signal x(n) is said to be causal if x(n)=0 for all negative values of n. By reversal of x(n) in time domain, an anti-causal signal x(−n) is obtained. The version of x(−n) time shifted to positive time indexes is also referred to as anti-causal, because the filter characteristics are time-reversed. Shifting the signal in time only introduces a linear phase component to the signal (a DC component is added to the group delay spectrum) and the amplitude spectrum is unaffected.

Figure 2:
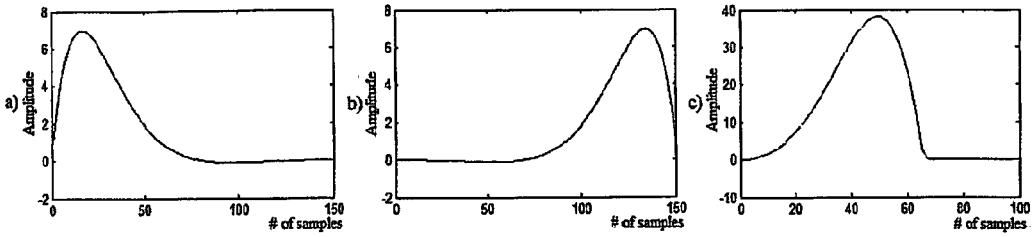
FIG. 2 shows the anti-causal character of the glottal flow signal. a) a causal filter response, b) an anti-causal filter response, c) a typical glottal flow signal.

The anti-causality assumption for the source is based on the characteristics of glottal flow models (as explained in detail in '*Spectral correlates of glottal waveform models: an analytic study*', Doval and d'Alessandro, Proc. ICASSP 97, Munich, pp. 446-452). One easy explanation is through visual inspection of signal waveforms. In FIG. 2 an example glottal flow signal is presented together with a causal and an anti-causal filter response. The glottal flow signal has the same characteristics as the anti-causal response, namely a slowly increasing function with a rather sharper decay. The glottal flow signals can be modelled by an all-pole system where the poles are anti-causal. For stability of an anti-causal all-pole system, all of the poles have to be out of the unit circle and therefore the system is maximum phase.

The mixed-phase model assumes speech signals have two types of resonances: anti-causal resonances of the source (glottal flow) signal and causal resonances of the vocal tract filter. Certain embodiments estimate these resonances from the speech signal. The estimation method is based on analysis of 'differential-phase spectra'.

The closest concept to differential-phase spectra is the group delay, so the differential-phase spectra will be introduced as a more general form of group delay. The source-tract separation is based on spectral analysis of causal and anti-causal parts of the speech signal. For such a target, the frequently used amplitude (or power) spectra offer very little help (if any). Rather the phase spectra have to be studied, since causality can only be observed in phase spectra. One of the main difficulties of phase analysis is its automatically wrapped nature. The phase spectra derivative however does not have the same property and various other advantages exist over both phase spectra and amplitude spectra. The group delay function GD(ϕ) is defined as the negative of derivative of the argument θ(ϕ) of X(ϕ), being the discrete Fourier transform of a signal x(n).

$$X(e^{j\Phi})=DFT(x(n))=a(\Phi)+jb(\Phi) \quad \text{(equation 1)}$$

$$\vartheta(\varphi)=\arctan\left(\frac{b(\varphi)}{a(\varphi)}\right) \quad \text{(equation 2)}$$

$$GD(\varphi)=-\frac{d(\vartheta(\varphi))}{d\varphi} \quad \text{(equation 3)}$$

Figure 3:
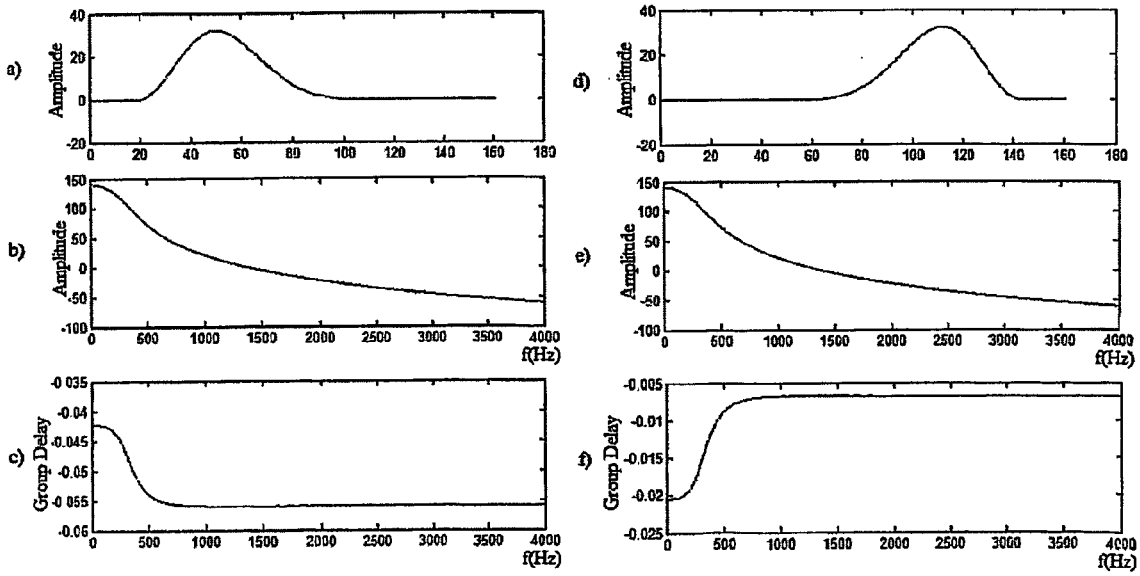
FIG. 3 represents a causal and an anti-causal single pole filter response plots: a) causal impulse response, b) log-amplitude spectrum of a), c) group delay spectrum of a), d) anti-causal impulse response, e) log-amplitude spectrum of d), f) group delay spectrum of d).

The causality feature of a resonance is best observed on group delay spectra since a reversal of a signal in the time domain corresponds to no change in power spectrum of the signal but the group delay spectrum is inverted horizontally. In FIG. 3 the effects of time reversal on the amplitude spectrum and group delay function are presented on an example. The signal in FIG. 3*a* is time reversed to obtain the signal in FIG. 3*d*. Comparison of FIG. 3*b* with FIG. 3*e* and FIG. 3*c* with FIG. 3*f* shows that the only change in frequency characteristics is horizontal inversion of the group delay function.

Figure 4:
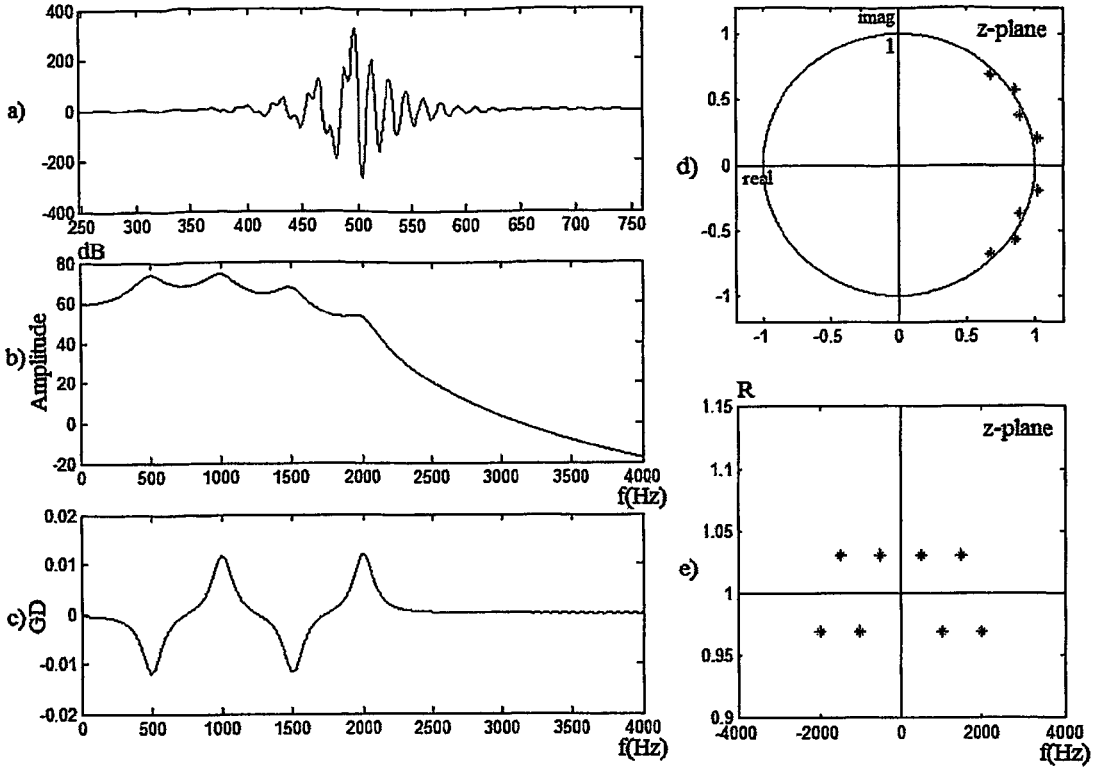
FIG. 4 represents a mixed phase all-pole signal with causal resonances at 1000 Hz and 2000 Hz and anti-causal resonances at 500 Hz and 1500 Hz. a) time domain signal, b) log-amplitude spectrum, c) group delay spectrum, d) poles on z-plane-cartesian coordinates, e) poles on z-plane-polar coordinates.

In FIG. 4 a mixed phase signal (synthesised with all-pole model) and its group delay spectrum are presented. The mixed phase signal in FIG. 4 is synthesised by convolving a causal filter response with resonances at 1000 Hz and 2000 Hz and anti-causal filter response with resonances at 500 Hz and 1500 Hz. The causal and anti-causal resonances appear as peaks with opposite direction on the group delay spectrum where on the amplitude spectrum causality or anti-causality cannot be observed. Therefore, for analysis of causality of resonances of mixed-phase signals like speech, group delay function processing (obtained from phase information) is advantageous to amplitude spectrum processing.

Figure 5:
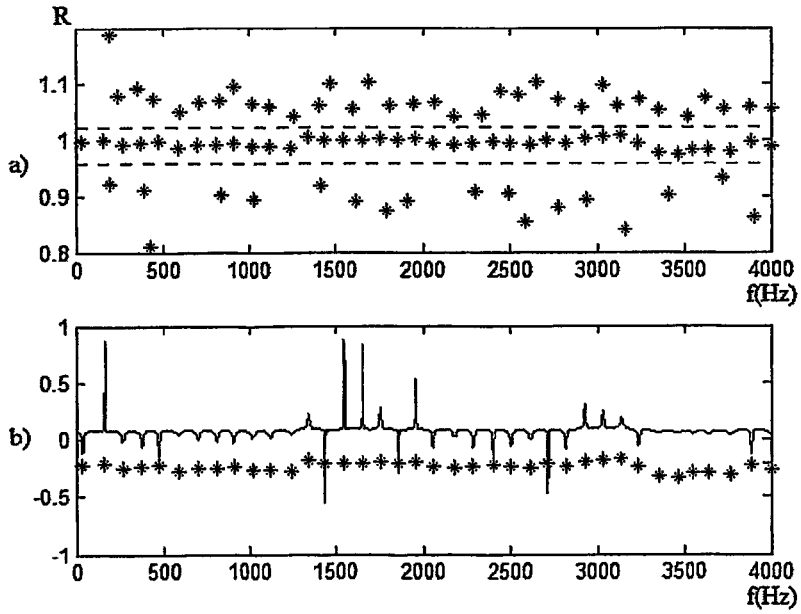
FIG. 5 shows the effect of zeros on the group delay function, a) Zeros of Z-Transform (ZZT) plotted in polar coordinates (region of zeros close to the unit circle indicated by dashed lines), b) group delay function with ZZT close to unit circle superimposed.

However, observation of these opposite direction peaks on group delay spectra for real speech signals is not easy due to existence of roots (zeros) of the z-transform located very closely to the unit circle on the z-plane. Each zero causes a spike in the group delay function masking important details of group delay function in that particular frequency region. The literal explanation is as follows: the Discrete Fourier Transform (DFT) of a signal can be expressed as $$X(e^{j\varphi}) = Ge^{(j\varphi)(-N+1)}\prod_{m=1}^{N-1}(e^{j\varphi} - Z_m) \quad \text{(equation 4)}$$

where $X(e^{j\Phi})$ denotes the z-transform of a discrete time sequence x(n), the $Z_m$ represent the roots of the z-transform and G is the gain factor. Each factor in (eq. 4) corresponds, in the z-plane, to a vector starting at $Z_m$ and ending at $e^{j\Phi}$. Hence, where $e^{j\Phi}$ gets very close to one of these zeros, one of the factors in (eq. 4) gets very small in amplitude, and undergoes an important argument modification which corresponds to spiky change in the group delay function. So, a simple observation on group delay spectrums does not provide the desired information, the plots are usually too noisy due to the zeros close to unit circle. In FIG. 5*b*, a group delay function for a speech frame is presented together with zeros of z-transform of the same signal closely located to the unit circle. Each zero creates a spike in the group delay function hiding resonance peaks to appear as in FIG. 4.

In the solution according to certain embodiments, the problem is first redefined in a more general framework of 'differential-phase spectrum'. The differential-phase spectrum is defined as the negative derivative of the phase spectrum calculated from the signal's z-transform, evaluated on a circle with any radius centered at the origin of the z-plane. This definition makes the group delay function a special case of differential-phase spectrum, where the radius of the circle is r=1. Changing the radius from r=1 to other values yields a new circle in a region where zeros do not exist. By calculating differential-phase spectra at this new circle, the spiky effects of the zeros can be avoided and resonance peaks can be tracked. Certain embodiments advantageously make use of the insight that signal resonances can be tracked from differential phase spectra calculated on circles with radius different from 1 (the unit circle), e.g., on circles with a radius either larger or smaller than 1. The analysis of more than one differential-phase spectrum is advantageous for the estimation of source and tract characteristics due to the poles existing inside and outside the unit circle (though a single differential-phase spectrum can also reveal all causal and anti-causal resonances). Therefore the method preferably includes the step of processing more than one differential-phase spectrum calculated at circles with different radius, as this yields an improved robustness.

The resulting differential-phase spectra are much less noisy than group delay functions, but still zeros may exist anywhere in the z-plane. A single unexpected zero causes the same type of spiky effect for the frequency regions, where the zero is close to the analysis circle. In order to get rid of this effect, a zero-removal technique is proposed that effectively calculates noise-free differential-phase spectra. The procedure comprises the steps of:

- estimating zeros (roots of z-transform polynomial of the speech signal) with a numerical method,
- removing or displacing zeros from z-plane regions, where the differential-phase spectrum is to be calculated, and
- calculating the differential-phase spectrum at this region from the remaining zeros.

The roots (zeros) of a z-transform polynomial can be determined by a numerical method. The obtained set of roots of the z-transform polynomial can be divided into two sets of roots (which corresponds to dividing the z-transform polynomial into two polynomials). The obtained two sets of roots correspond to the spectral representation of glottal flow and vocal tract contributions of speech signal: when classifying the roots according to their distance to the origin of the z-plane (i.e., their radius), roots outside the unit circle are classified as glottal flow roots and roots inside the unit circle as vocal tract roots. For estimation of the characteristics of one of the systems, it is preferred to remove the set roots corresponding to the other system and then perform analysis. For example, for estimation of vocal tract characteristics, glottal flow roots which are out of the unit circle are removed from the complete set of zeros and then the differential-phase spectrum calculation is performed.

By additionally applying this zero-removal method, no zeroes close to analysis circle will be left and the differential-phase spectrum obtained will not include zero spikes.

Figure 6:
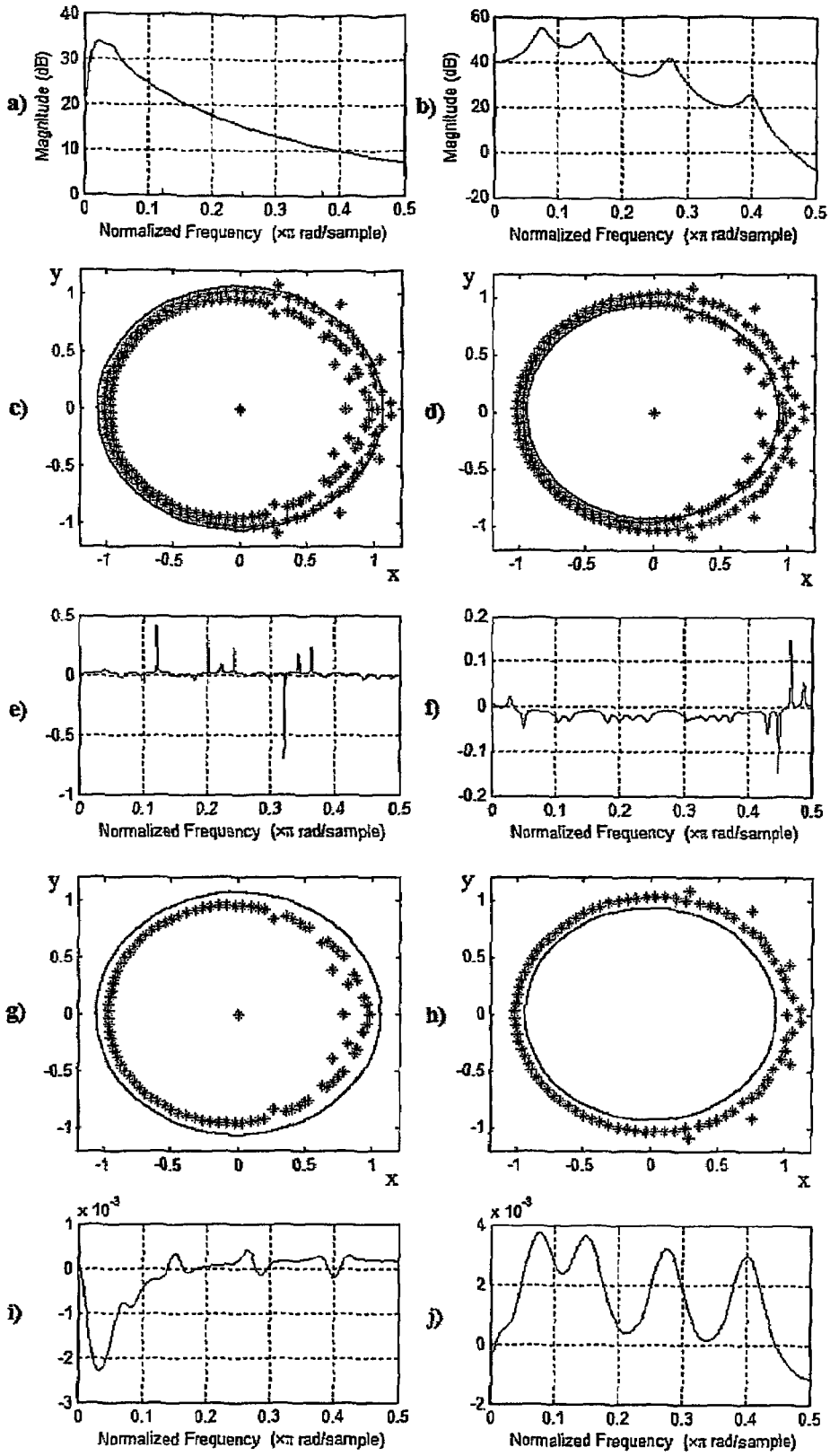
FIG. 6 represents an example of differential-phase spectrum analysis of synthetic speech.

An example on synthetic speech analysis is presented in FIG. 6 for the zero-removal technique and its effect to differential-phase spectrum. The first row of plots include the actual amplitude spectrum of glottal flow (FIG. 6*a*) and the amplitude spectrum vocal tract (FIG. 6*b*) used in synthesis. The aim is to estimate the resonance peak (formant) locations of these two systems directly from the speech signal, which is constructed by convolution of these two systems and an impulse train to obtain several cycles of speech signal. An all-pole vocal tract filter (of a typical vowel "a" with normalised resonance frequencies at 0.075, 0.15, 0.275, 0.4 for 16000 Hz) is used for synthesis. This synthetic speech signal is windowed for analysis. Estimation of formant frequencies by peak picking on differential-phase analysis at two circles are aimed: r=0.95 and r=1.05. The ZZT of windowed speech signal is presented in FIG. 6*c* and FIG. 6*d* with the analysis circles indicated on top. The differential-phase spectra obtained on the indicated analysis circles are presented in FIG. 6*e* and FIG. 6*f* respectively. Since zeros close to analysis circles exist, the resulting differential-phase spectra are noisy. To get rid of this effect, zeros close to the analysis circle are removed (as plotted in FIG. 6*g* and FIG. 6*h*) and differential-phase spectra are re-calculated. The resulting differential-phase spectra are presented in FIG. 6*i* and FIG. 6*j*. Peak picking is performed on these spectra and sign and frequencies of the peaks are stored. The negative peak in FIG. 6*i* will be classified as glottal formant peak and the positive peaks on FIG. 6*j* will be classified as vocal tract formant peaks in the final decision.

Figure 7:
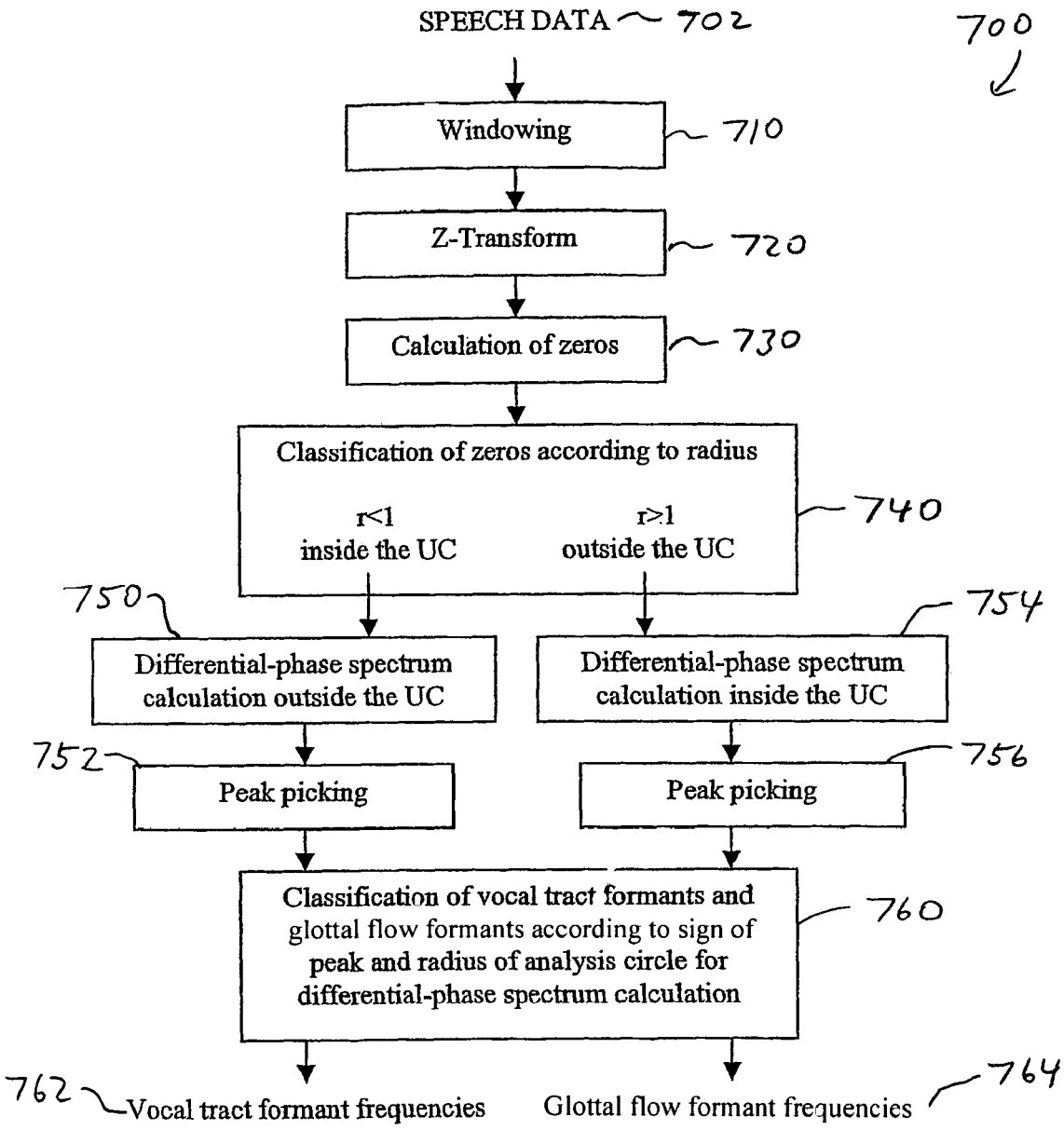
FIG. 7 represents a flowchart of the method according to one embodiment.

Finally, FIG. 7 summarises a process of estimating resonance frequencies 700 according to one embodiment in a flowchart. The various steps are as described previously. The process 700 begins with speech data 702 that is input to a windowing state 710. Proceeding to state 720, process 700 performs a z-transform and then advances to state 730 for calculation of zeros. Continuing at state 740, process 700 performs classification of zeros according to radius. If the radius (r) is less than one (that is, inside the unit circle (UC)), process 700 advances to state 750 and performs a differential-phase spectrum calculation outside the UC. Based on the results of the calculations at state 750, process 700 then performs peak picking at state 752. Returning to the description of state 740, if r is greater than one (that is, outside the UC), process 700 advances to state 754 and performs a differential-phase spectrum calculation inside the UC. Based on the results of the calculations at state 754. process 700 then performs peak picking at state 756. At the completion of peak picking states 752 or 756, process 700 continues at state 760 to perform classification of vocal tract formants and glottal flow formants according to the sign of the peak and radius of the analysis circle for the differential-phase spectrum calculation. The results of the classification performed at state 760 are vocal tract formant frequencies 762 and glottal flow formant frequencies 764.

The invention claimed is:

1. A method for estimating from an input signal the resonance frequencies of a system modelled as a source and a filter, the method comprising:

determining the Z-transform of an input signal;

calculating the differential-phase spectrum of said Z-transformed input signal, said Z-transform thereby being evaluated on a circle centered around the origin of the Z-plane;

detecting the peaks on said differential-phase spectrum;

attributing said peaks to either a source or a filter; and estimating said resonance frequencies from said peaks.

2. The method for estimating the resonance frequencies as in claim 1, wherein said circle is different from the unit circle in the Z-plane.

3. The method for estimating the resonance frequencies as in claim 1, wherein said Z-transform of said input signal is evaluated on more than one circle.

4. The method for estimating the resonance frequencies as in claim 1, wherein said input signal is windowed.

5. The method for estimating the resonance frequencies as in claim 1, wherein said input signal is a speech signal.

6. The method for estimating the resonance frequencies as in claim 1, wherein said source is a glottal flow signal.

7. The method for estimating the resonance frequencies as in claim 1, wherein said filter is a vocal tract system.

8. The method for estimating the resonance frequencies as in claim 1, wherein attributing said peaks is performed based on The sign of said peaks.

9. The method for estimating the resonance frequencies as in claim 8, wherein attributing is further based on the radius of said circle.

10. The method for estimating the resonance frequencies as in claim 1, further comprising removing zeros of said input signal's Z-transform before performing calculating said differential-phase spectrum.

11. A computer usable medium having computer readable program code embodied therein for estimating from an input signal the resonance frequencies of a system modeled as a source and a filter, the computer readable code comprising instructions for:

determining the Z-transform of an input signal;

calculating the differential-phase spectrum of said Z-transformed input signal, said Z-transform thereby being evaluated on a circle centered around the origin of The Z-plane;

detecting the peaks on said differential-phase spectrum;

attributing said peaks to either a source or a filter; and estimating said resonance frequencies from said peaks.

* * * * *

UNITED STATES PATENT AND TRADEMARK OFFICE

CERTIFICATE OF CORRECTION

PATENT NO. : 7,333,931 B2
APPLICATION NO. : 10/568150
DATED : February 19, 2008
INVENTOR(S) : Baris Bozkurt et al.

It is certified that error appears in the above-identified patent and that said Letters Patent is hereby corrected as shown below:

| Column | Line | Description of Error |
|---|---|---|
| 2 | 15 | Delete "199)." and insert -- 1991). --, therefor. |
| 3 | 29 (Approx.) | Delete "INVENTION" and insert -- INVENTIVE --, therefor. |
| 7 | 8 | Delete "754." and insert -- 754, --, therefor. |
| 8 | 11 | In Claim 8, delete "The" and insert -- the --, therefor. |
| 8 | 29 (Approx.) | In Claim 11, delete "The" and insert -- the --, therefor. |

Signed and Sealed this

Twenty-second Day of December, 2009

David J. Kappos

David J. Kappos
*Director of the United States Patent and Trademark Office*